US006151998A

United States Patent [19]

Fu-Hui

[11] Patent Number: 6,151,998

[45] Date of Patent: Nov. 28, 2000

[54] HANDLE STRUCTURE FOR A SCREWDRIVER

[76] Inventor: Lin Fu-Hui, 11F-2, No. 43, Chai-I Street, Taichung City, Taiwan

[21] Appl. No.: 09/440,078

[22] Filed: Nov. 15, 1999

[51] Int. Cl.[7] ..... B25B 23/16

[52] U.S. Cl. ..... 81/177.4; 81/177.1; 81/489; 81/490

[58] Field of Search ..... 81/177.4, 177.1, 81/489, 490

[56] References Cited

U.S. PATENT DOCUMENTS 4,779,493 10/1988 White .
5,868,048 2/1999 Cassutti et al. .
5,911,798 6/1999 Arnold .
5,957,014 9/1999 Tseng et al. .

*Primary Examiner*—David A. Scherbel
*Assistant Examiner*—Willie Berry, Jr.
*Attorney, Agent, or Firm*—Charles E. Baxley

[57] ABSTRACT

A handle structure for a screwdriver includes a first handle having a passage defined therein and a second handle is received in the passage. A positioning device is located in the passage so as to secure the second handle in position. A shank extends from the first handle. The second handle has a neck portion extending therefrom. The neck portion has an engaging hole so as to engage with a bit.

10 Claims, 6 Drawing Sheets

HANDLE STRUCTURE FOR A SCREWDRIVER

FIELD OF THE INVENTION

The present invention relates to a handle structure screwdriver wherein the handle includes a primary handle that has a passage in which another handle is removably received. Either of the two handles is able to be independently cooperated with a bit.

BACKGROUND OF THE INVENTION

A conventional screwdriver generally includes a handle and a shank extending from the handle. Normally, the handle and the shank are made as a one-piece member so that the shank cannot be removed from the handle. Taking the screwdriver that has a T-shaped handle as example, the T-shaped handle allows the user to hold the handle and to output a torque conveniently. However, the T-shaped handle occupies a larger space so that if the object is located in a narrow space, the T-shaped handle could not be properly used and the user has to get a screwdriver that has a smaller T-shaped handle.

The present invention intends to provide a screwdriver that has a T-shaped handle and the handle has a passage for receiving another T-shaped handle so that the user can conveniently use the two handles with different size according to practical needs.

SUMMARY OF THE INVENTION

In accordance with one aspect of the present invention, there is provided a handle structure for a screwdriver and comprising a first handle having a passage defined therein and a positioning means located in the passage. The first handle has a shank extending therefrom. A second handle is removably received in the passage in the first handle. A neck portion extends from the second handle and an engaging hole is defined in the neck portion.

The object of the present invention is to provide a handle structure for a screwdriver wherein the handle has another smaller handle removably received therein. Each of the two handles can be cooperated with a bit so as to tighten or loosen a nut or a bolt according to needs.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
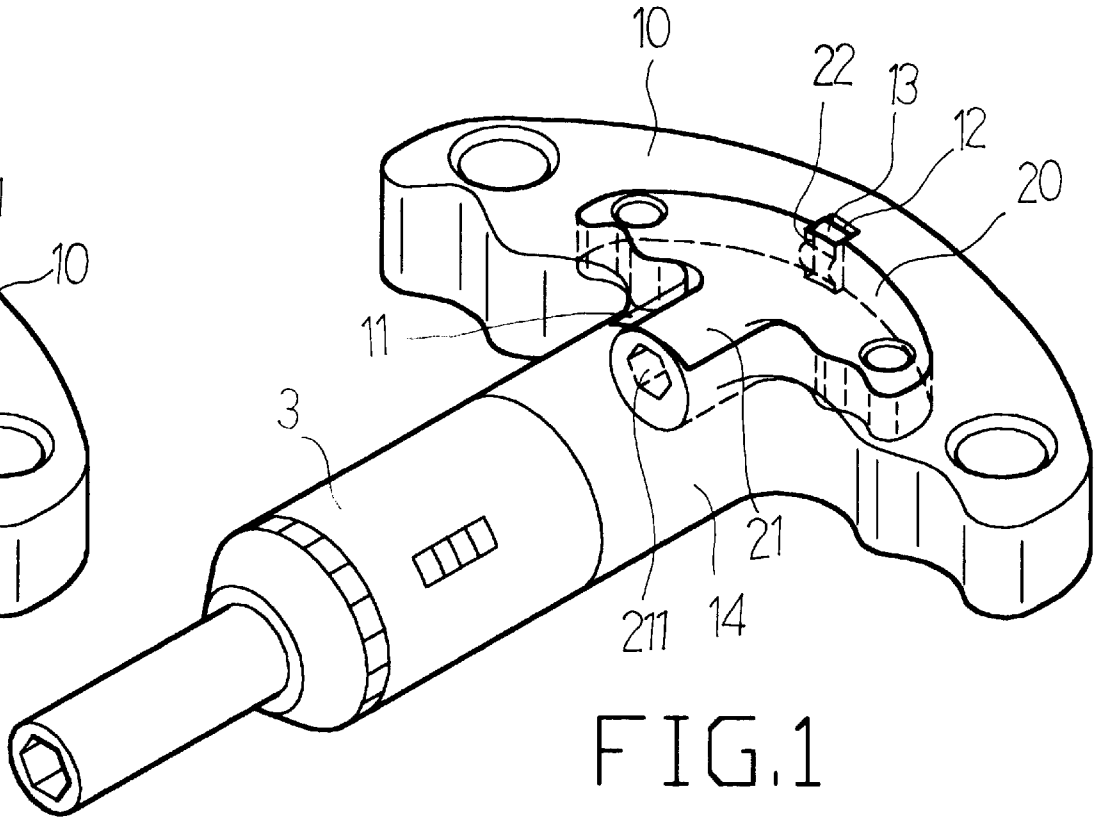
FIG. 1 is a perspective view to show the screwdriver having a handle structure in accordance with the present invention.
Figure 2:
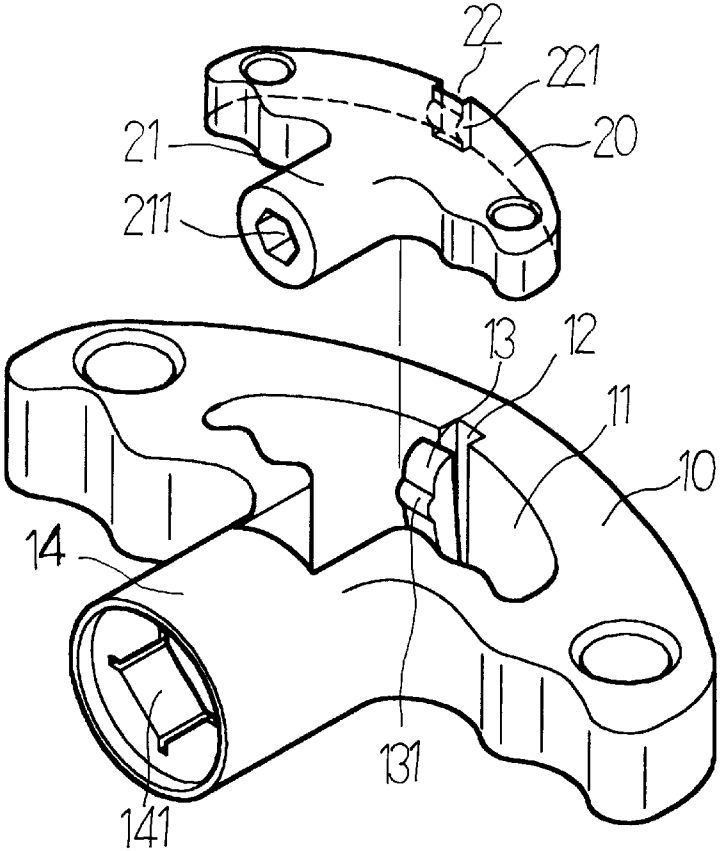
FIG. 2 is an exploded view to show the handle of the present invention.
Figure 5:
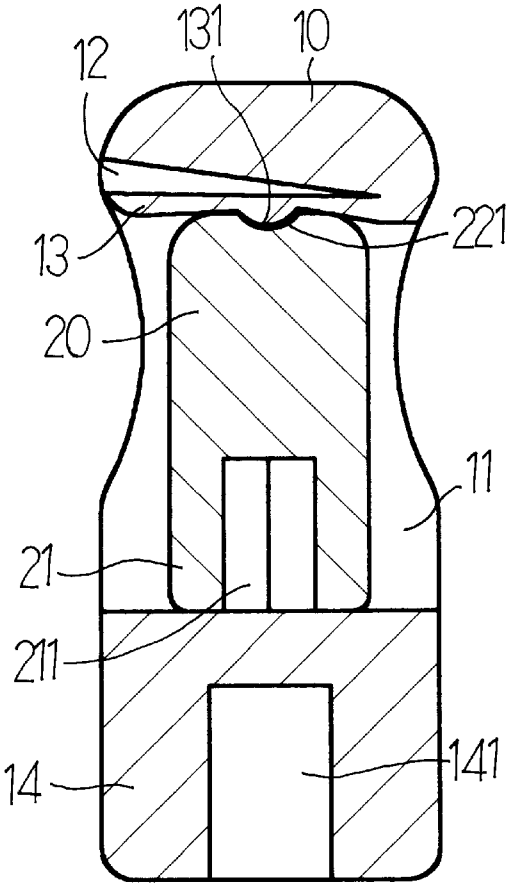
FIGS. 3–5 respectively show the processes of a second handle engaged with the first handle of the present invention.
Figure 4:
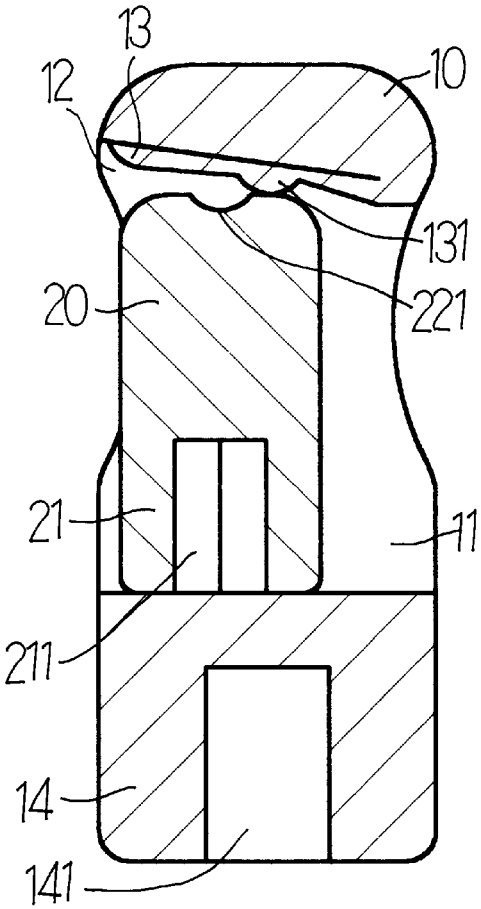
Figure 3:
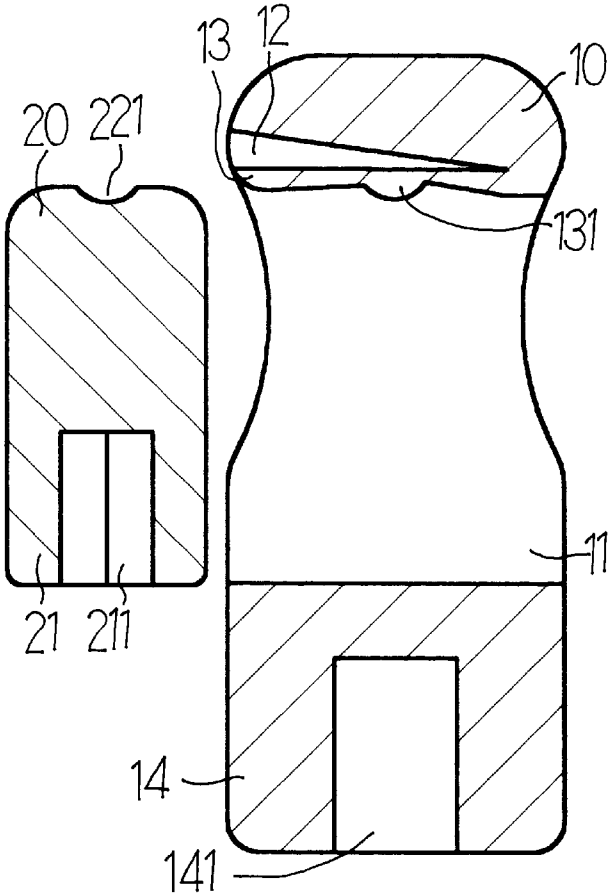

Referring to FIGS. 1 to 5, the handle structure in accordance with the present invention comprises a first handle 10 having a passage 11 defined therein and a biasing plate 13 extending from an inside of the passage 11. The biasing plate 13 has a protrusion 131. A notch 12 is defined in the inside of the passage 11 so that the biasing plate 13 can be received in the notch 12 when the biasing plate 13 is pressed. A shank 14 extends from the first handle 11 and has an engaging hole 141 defined therein so as to receive a bit 3 or the like. A second handle 20 is sized to be received in the passage 11 in the first handle 10 and a neck portion 21 extends from the second handle 20. An engaging hole 211 is defined in the neck portion 21 so as to be engaged with a bit. As shown in FIGS. 3 to 5, when inserting the second handle 20 into the passage 11 in the first handle 11, the biasing plate 13 is urged the second handle 20 in position. The second handle 20 has a recess 22 defined therein and a concave 221 defined in an inside of the recess 22 so that the protrusion 131 of the biasing plate 13 is engaged with the concave 221 of the recess 22 of the second handle 20. Therefore, the user may use the tool having the first handle 10 or the tool having the second handle 20 according to the practical needs. The second handle is smaller than that of the first handle 10 so as to be used in a smaller space.

Figure 6:
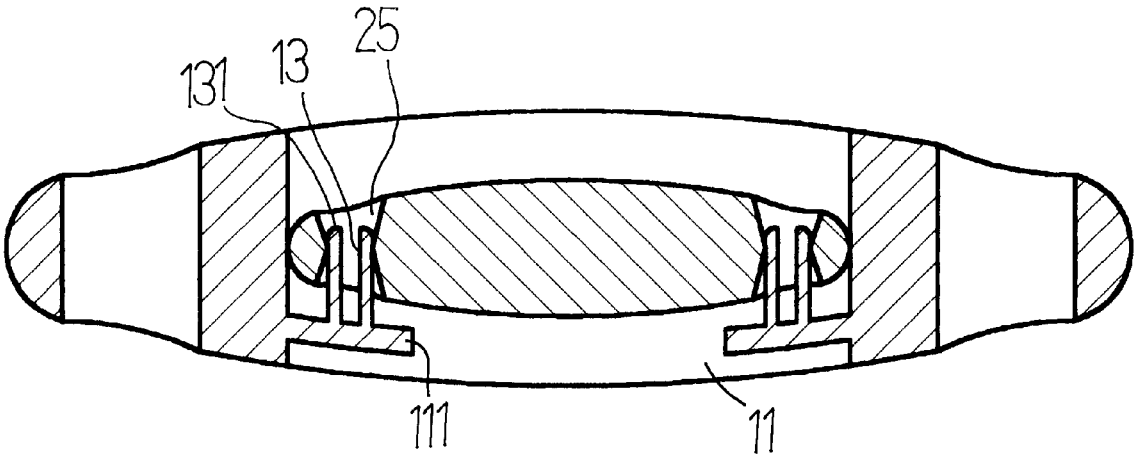
FIG. 6 is a cross-sectional view to show another embodiment of the positioning means to secure the second handle in the first handle of the present invention.

As shown in FIG. 6 which shows another embodiment of the engagement between the first handle 10 and the second handle 20. There are two ribs 111 extending from an inside of the passage 11 and each rib 111 has two twigs 13 extending therefrom. The second handle 20 has two apertures 25 defined therethrough so that the twigs 13 are respectively engaged with the two apertures 25 of the second handle 20. The inside of each aperture 25 has a peak portion and each twig 13 has an engaging surface 131 so as to engage with the peak potion in the aperture 25.

Figure 7:
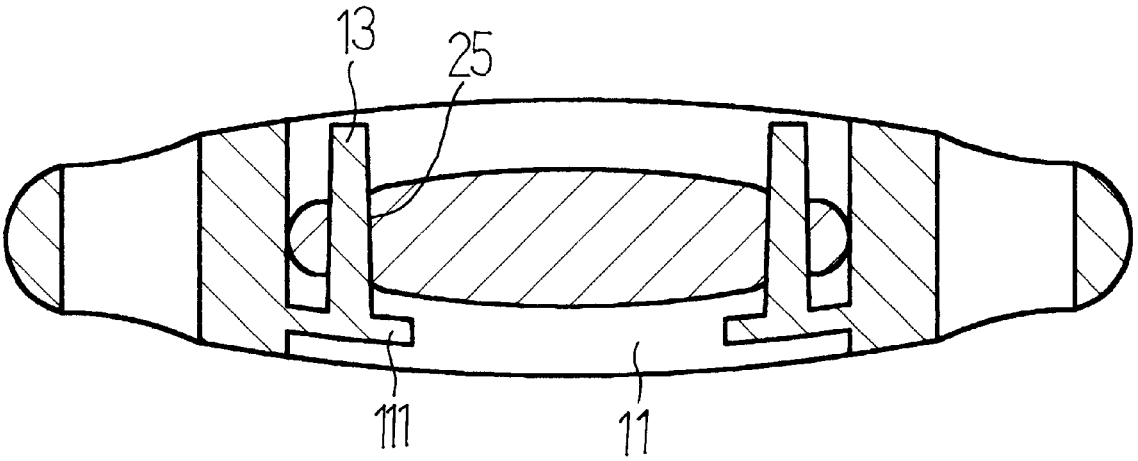
FIG. 7 is a cross-sectional view to show yet another embodiment of the positioning means to secure the second handle in the first handle of the present invention.

FIG. 7 shows another embodiment of the engagement between the first handle 10 and the second handle 20. Two ribs 111 extend from an inside of the passage 11 and each rib 111 has a rod 130 extending therefrom. The second handle 20 has two apertures 25 defined therethrough so that the rods 130 are respectively engaged with the two apertures 25 of the second handle 20, wherein each rod 130 has a tapered outside and each aperture 25 has a tapered inside.

Figure 8:
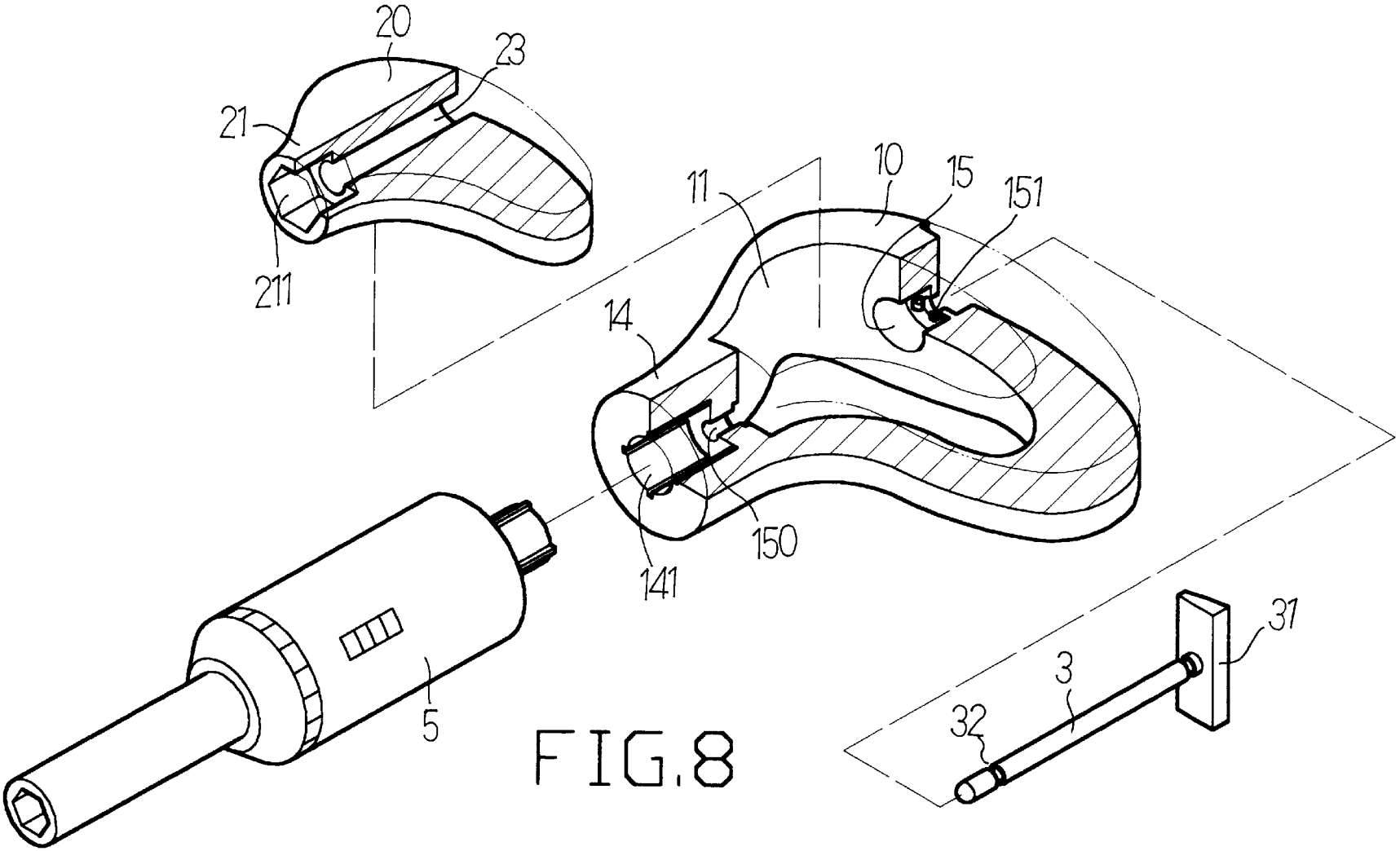
FIG. 8 is an exploded view to show another embodiment of the handle structure of the present invention.
Figure 9:
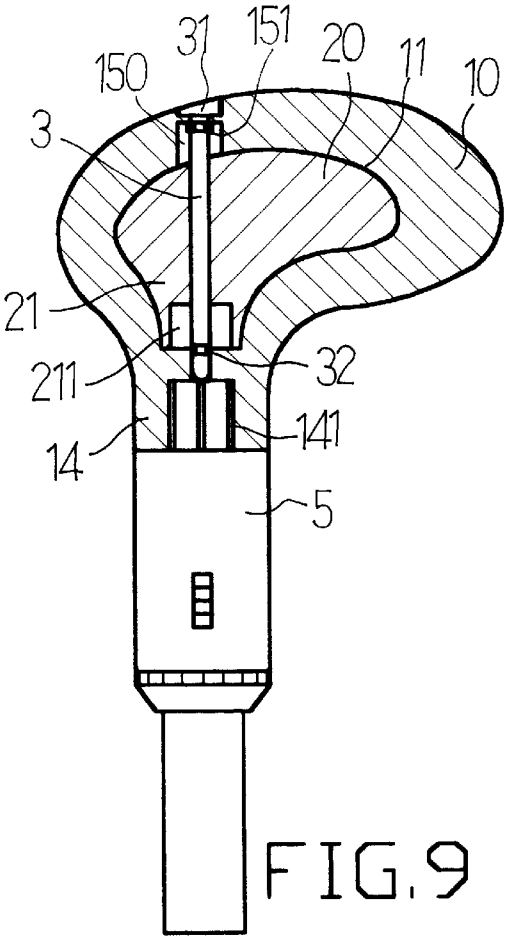
FIG. 9 shows that the first handle and the second handle as shown in FIG. 8 is connected by a positioning rod.

FIGS. 8 and 9 show another embodiment of the handle structure of the present invention. A first handle 10 has a passage 11 defined therein and a shank 14 extends from the first handle 10. An engaging hole 141 is defined in the shank 14 so as to engage with a bit 5 or the like. The first handle 10 has a first hole 15 defined therethrough and communicating with the passage 11. The first hole 15 is located away from the first handle 10. A second hole 150 is defined in an inside of the passage 11 and extends through the shank 14 so as to communicate with the engaging hole 141. A second handle 20 is sized to be received in the passage 11 in the first handle 10. A neck portion 21 extends from the second handle 20 and an engaging hole 211 defined in the neck portion 21. A tunnel 23 is defined through the second handle 20. The first hole 15 and the second hole 150 are located in alignment with the tunnel 23 in the second handle 20 when the second handle 20 is received in the passage 11 in the first handle 10. A flange 151 extends radially inward from an inside of the first hole 15.

A positioning rod 3 having two annular grooves 32 and a head 31 extends through the first handle 10, the tunnel 23 in the second handle 20 and the second hole 150 to combine the first handle 10 and the second handle 20, wherein the annular groove 32 close to the head 31 is engaged with the flange 151 so that the positioning rod 3 will not drop.

Figure 10:
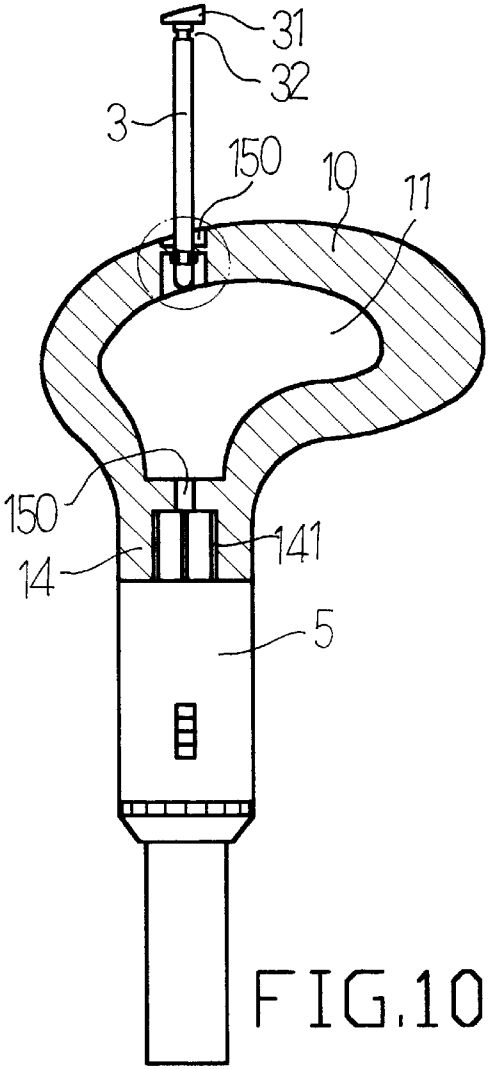
FIG. 10 shows that the second handle is removed from the first handle by pulling the positioning rod.
Figure 11:
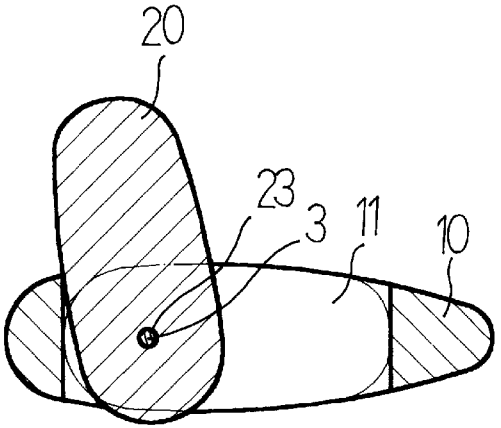
FIG. 11 is an illustrative view to show that the second handle is pivoted about the positioning rod.

FIG. 10 shows that when removing the second handle 20 from the first handle 10, the user holds the head 31 and pulls the positioning rod 3 till the other annular groove 32 away from the head 31 is engaged with the flange 151. By this way, the second handle 20 can be removed from the first handle 11. The second handle 20 can also be pivoted about the positioning rod 3 to extend laterally from the first handle 10 so that the user can hold the first handle 10 and the second handle 20 firmly.

Figure 12:
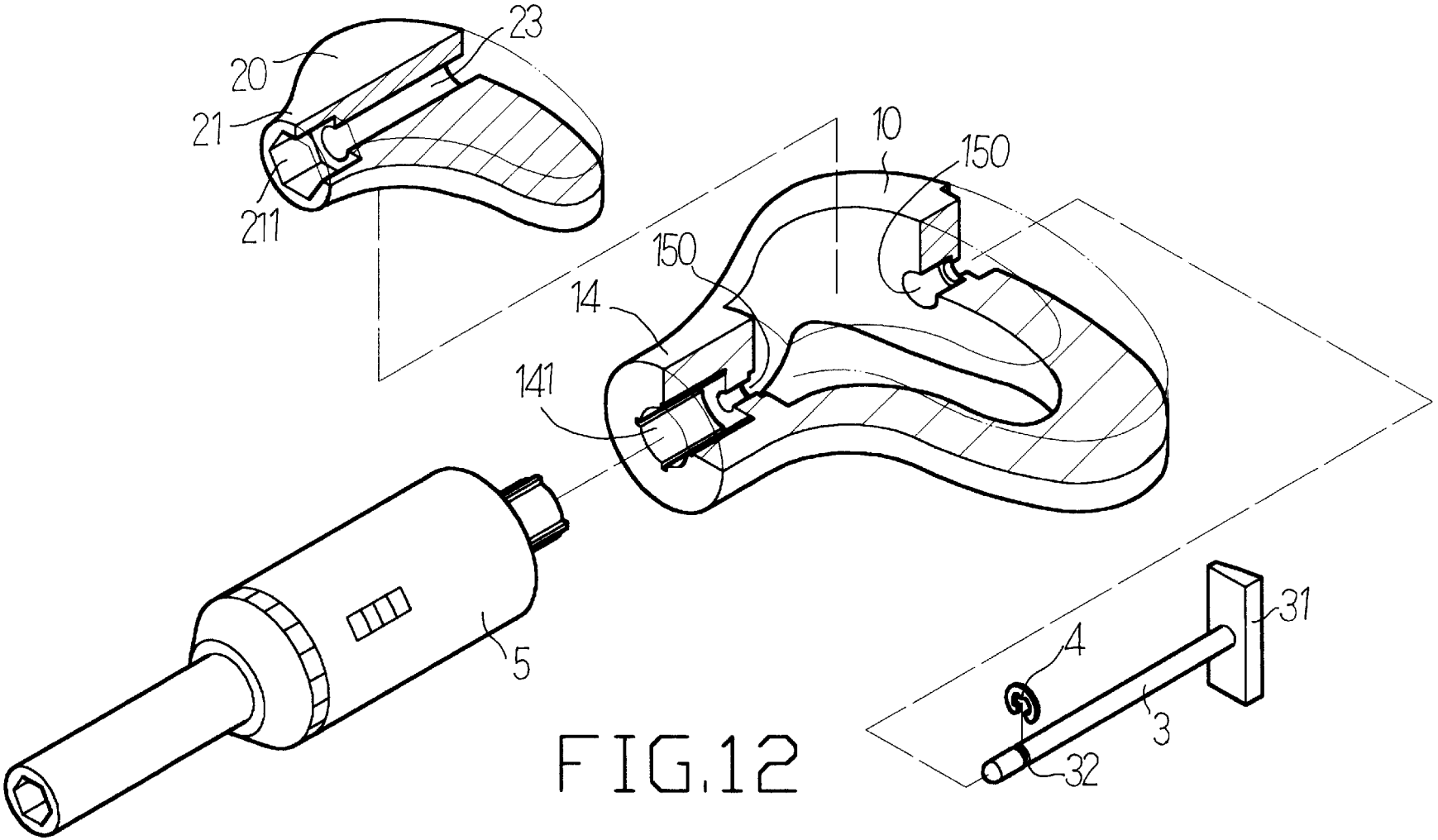
FIG. 12 shows a further embodiment of the positioning rod used to connect the first handle and the second handle.

As shown in FIG. 12, in order to prevent the positioning rod 3 from dropping from the first hole 15, a C-clip 4 can be used to engage with the annular groove 32 so that when the positioning rod 3 is pulled, the C-clip 4 will be stopped by the first hole 15.

While we have shown and described various embodiments in accordance with the present invention, it should be clear to those skilled in the art that further embodiments may be made without departing from the scope and spirit of the present invention.

What is claimed is:

1. A handle structure for a screwdriver comprising:

a first handle having a passage defined therein and a positioning means located in said passage, said positioning means including a biasing plate extending from an inside of said passage, a shank extending from said first handle, and a second handle sized to be received in said passage in said first handle and said biasing plate urged said second handle in position, a neck portion extending from said second handle and an engaging hole defined in said neck portion.

2. The handle structure as claimed in claim 1 further comprising an engaging hole defined in said shank.

3. The handle structure as claimed in claim 1, wherein said biasing plate has a protrusion and said second handle has a recess defined therein so that said protrusion of said biasing plate is engaged with said recess of said second handle.

4. The handle structure as claimed in claim 1, wherein said positioning means includes two ribs extending from an inside of said passage and each rib has two twigs extending therefrom, said second handle having two apertures defined therethrough so that said twigs are respectively engaged with said two apertures of said second handle.

5. The handle structure as claimed in claim 1, wherein said positioning means includes two ribs extending from an inside of said passage and each rib has a rod extending therefrom, said second handle having two apertures defined therethrough so that said rods are respectively engaged with said two apertures of said second handle.

6. The handle structure as claimed in claim 5, wherein each rod has a tapered outside and each aperture has a tapered inside.

7. A handle structure for a screwdriver comprising:

a first handle having a passage defined therein and a shank extending from said first handle;

a second handle sized to be received in said passage in said first handle, a neck portion extending from said second handle and an engaging hole defined in said neck portion, a tunnel defined through said second handle, and a positioning rod extending through said first handle and said tunnel in said second handle to combine said first handle and said second handle.

8. The handle structure as claimed in claim 7 further comprising an engaging hole defined in said shank.

9. The handle structure as claimed in claim 7, wherein said first handle has a first hole defined therethrough and communicating with said passage, said first hole located away from said first handle, a second hole defined in an inside of said passage and extending into said shank, said first hole and said second hole located in alignment with said tunnel in said second handle.

10. The handle structure as claimed in claim 9, wherein said positioning rod has an annular groove defined in an outer periphery thereof and a flange extends radially inward from an inside of said first hole so that said annular groove is engaged with said flange.

* * * * *